US005521982A

United States Patent [19]

Schiftan

[11] Patent Number: 5,521,982

[45] Date of Patent: May 28, 1996

[54] ELECTRONIC DEVICE FOR THE GENERATION OF ACOUSTIC SPATIAL EFFECTS

[76] Inventor: Yair Schiftan, Illnauerstr. 10, CH-8307 Effretikon, Switzerland

[21] Appl. No.: 271,370

[22] Filed: Jul. 9, 1994

[30] Foreign Application Priority Data

Jul. 19, 1993 [CH] Switzerland ..... 02168/93

[51] Int. Cl.[6] ..... H04R 5/02

[52] U.S. Cl. ..... 381/25; 381/151

[58] Field of Search ..... 381/151, 1, 98, 381/25

[56] References Cited

U.S. PATENT DOCUMENTS

| | | | |
|---|---|---|---|
| 3,875,334 | 4/1975 | Hilbert et al. | 381/98 |
| 4,779,615 | 10/1988 | Frazier | 128/33 |
| 4,821,323 | 4/1989 | Papiernik | 381/25 |
| 5,323,468 | 6/1994 | Bottesch | 381/151 |

FOREIGN PATENT DOCUMENTS 0244508 11/1986 European Pat. Off. .

OTHER PUBLICATIONS

Tremaine, Audio Cyclopedia, 1980, pp. 1143, 1144.

*Primary Examiner*—Forester W. Isen

*Attorney, Agent, or Firm*—Brumbaugh, Graves, Donohue & Raymond

[57] ABSTRACT

The present invention relates to an electronic device for the generation of acoustic spatial effects, which comprises two branch points being connected to an inlet for the left or right signal channels, respectively, of an external source; two earphone outlets for earphones for the left and right ears, respectively; two outlets for two vibrators; between each branch point and the corresponding earphone being inserted a passive circuit; each branch point being connected to the corresponding vibrator via a passive circuit or via a short circuit line. Said passive circuit may comprise a filter system which may be connected via a digital signal processor to an inlet of a terminal amplifier. Said filter system may constitute a sound control system.

1 Claim, 2 Drawing Sheets

ELECTRONIC DEVICE FOR THE GENERATION OF ACOUSTIC SPATIAL EFFECTS

The present invention relates to an electronic device for the generation of acoustic spatial effects.

The present invention consists in an electronic device for the generation of acoustic spatial effects, characterized in that it comprises:

a) a first branch point being connected to an inlet for the left signal channel of an external source;

b) a second branch point being connected to a second inlet for the right signal channel of said external source;

c) an earphone outlet for an earphone for the left ear;

d) an earphone outlet for an earphone for the right ear;

e) an outlet for a first vibrator; and f) a second outlet for a second vibrator;

between each branch point and a corresponding earphone outlet being inserted a passive circuit and each branch point being connected with the corresponding vibrator outlet via a passive circuit or via a short circuit line.

The passive circuit contains preferably a filter system. Suitably various vibrators are connected to each branch point via an additional filter system. An amplifier is preferably connected after each filter system. Said amplifier is suitably inserted between an inlet and the corresponding branch point.

In a preferred embodiment according to the present invention the outlet of a first filter system is connected with a first terminal amplifier, which amplifier contains an adjustable amplifier for the control of a first earphone; the outlet of a second filter system is connected to a second terminal amplifier which contains an adjustable amplifier for the control of a second earphone; the outlet of a third filter system is connected on the one hand with the first inlet of a third terminal amplifier which contains an adjustable amplification for the control of a first vibrator transducer, and on the other hand is connected with the first inlet of a regulator system; the outlet of a fourth filter system is connected on the one hand with the first inlet of a fourth terminal amplifier, which amplifier has an adjustable amplification, for the control of a second vibrator transducer, and on the other hand is connected with the second inlet of the regulator system; the first outlet of the regulator system is connected with the second inlet of the fourth terminal amplifier and the second outlet of said regulator system is connected with the second inlet of the third terminal amplifier.

In a device according to the present invention the outlets of the filter circuit may be connected via a digital signal processor each time to an inlet of a terminal amplifier. The filter system may constitute, e.g. a sound control system.

The present invention will now be illustrated with reference to the accompanying drawings without being limited by same. In said drawings.

Figure 1:
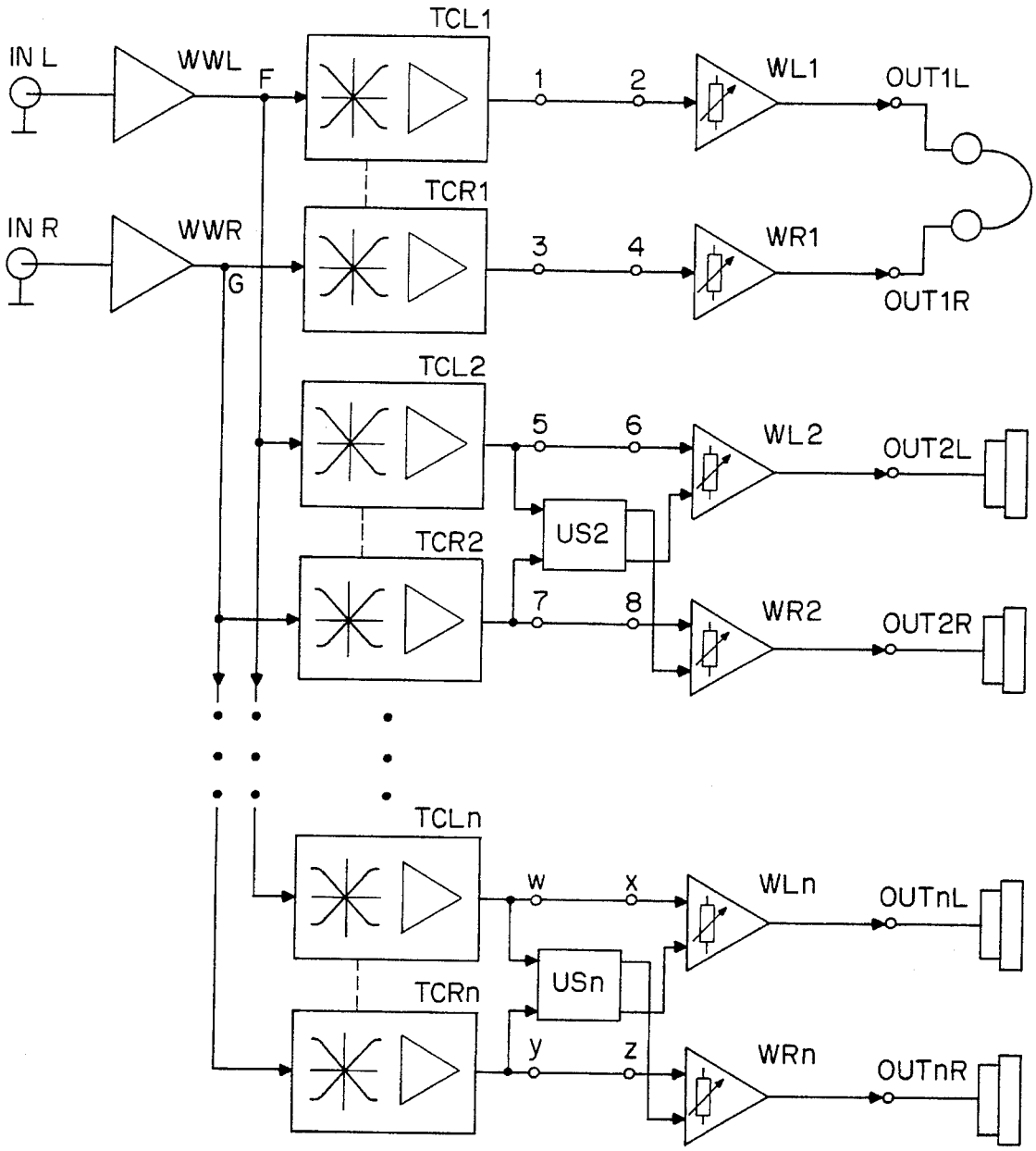
FIG. 1 shows a circuit diagram of an embodiment of the device according to the present invention.

The device according to FIG. 1 is provided with inlet INL for the signal coming from the left channel of an external source, said signal being conducted to inlet amplifier WWL. This enables the adjustment of the signal strength for the requirements of the blocks connected after same. A signal is conducted from a right channel of the external source over inlet INR up to inlet amplifier WWR which has the same function as amplifier WWL. After amplification the signals are conducted further on as follows:

The signal originating from the left channel is conducted via first branch point F up to sound control systems TCL1 and TCL2 and the signal originating from the right channel is conducted over second branch point G up to systems TCR1 and TCR2. Systems TCL1, TCL2, TCR1 and TCR2 are filter systems which enable to change the characteristic in the domain of the frequency of the original sound or of the sound sources.

The external signal of system TCL1 is forwarded to terminal amplifier WL1 which is provided with an adjustable amplification which controls the earphone at the left ear. The signal of system TCR1 is conducted to terminal amplifier WR1 which is provided with an adjustable amplification which controls the earphone at the right ear. The outlet signal of system TCL2 is conducted towards the first inlet of terminal amplifier WL2 which amplifier WL2 is provided with an adjustable amplification which controls a left bone-vibrator-transducer. Said outlet signal is also conducted to the first inlet of regulator system US2. The outlet signal of system TCR2 is conducted, on the one hand, to the first inlet of terminal amplifier WR2, which amplifier WR2 is provided with an adjustable amplification which controls the right bone-vibrator-transducer, and is conducted on the other hand to the second inlet of system US2. The first outlet of regulator system US2 is connected to the second outlet of fourth terminal amplifier WR2. The second outlet of regulator system US2 is connected to the second outlet of third terminal amplifier WL2.

Regulator system US2 is provided with a regulator which varies the characteristics of the frequencies and is also provided with an adjustable amplification for each inlet signal. The purpose of the regulator system US2 is to obtain a better result of the stereophonic effects on the basis of different signal amplifications for both channels in the chosen frequency band.

The amplifiers are provided with a current amplification which is adjusted to the working requirements of the bone-vibrator-transducer. The device is fed from a double ±15 V power supply which enables an optimal function of the operation amplifier. Further switchings TCLn, TCRn, USn, WLn, and WRn may be connected at branch points F and G.

Figure 2:
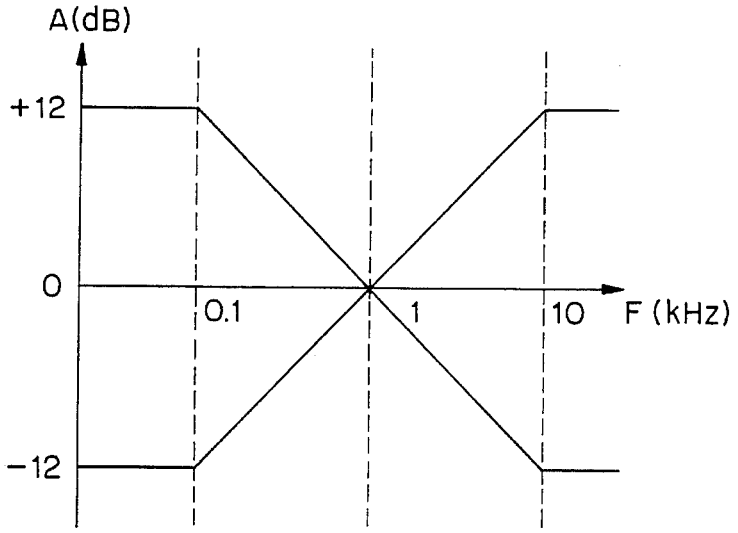
FIG. 2 shows a schematic illustration of a filter characteristic.

FIG. 2 shows the filter characteristics of systems TCL1, TCL2, TCR1, TCR2 . . . which preferably operate in the range between 0.1 and 10 kHz.

The device according to the present invention enables the observation of sounds via bone- and air conduits with the aid of electro acoustic transducers in order to cause the impression of a quasi-quadrophonic or pseudo-spatial effect.

The bone-vibrator-transducer may be placed on the head or on other parts of the body and is therefore suitable to generate various acoustic and vibrational effects. Said effects are suitable to generate psychoacoustic phenomena by way of a spatial performance of musical sources. A special use of the device according to the present invention is being obtained by therapeutic method in that the sound or music source is conducted via the headphone and/or over the bone-vibrators in order to influence the neurosensorial system of the body by the use of various therapeutic methods.

The device according to the present invention operates as follows:

The inlet signal is conducted to inlets INL and INR and thereafter is conducted via inlet amplifiers WL1, WR1, WL2, WR2 . . . WLn and WRn. All outlet amplifiers possess amplifications which may be adjusted independently from each other. A signal originating from the outlet amplifiers is conducted to the transducers, which may be earphones and/or bone vibrators via outlets OUT1L, OUT1R, OUT2L, OUT2R . . . OUTnL, and OUTnR.

In a further embodiment of the device according to the present invention, the device may cause an independent sound control of each channel with the aid of blocks TCL1, TCR1, TCL2, TCR2 . . . TCLn, and TCRn.

The signals for the bone vibrators may be conducted via inlets INL and INR and be amplified independently by blocks US2 up to USn.

Figure 3:
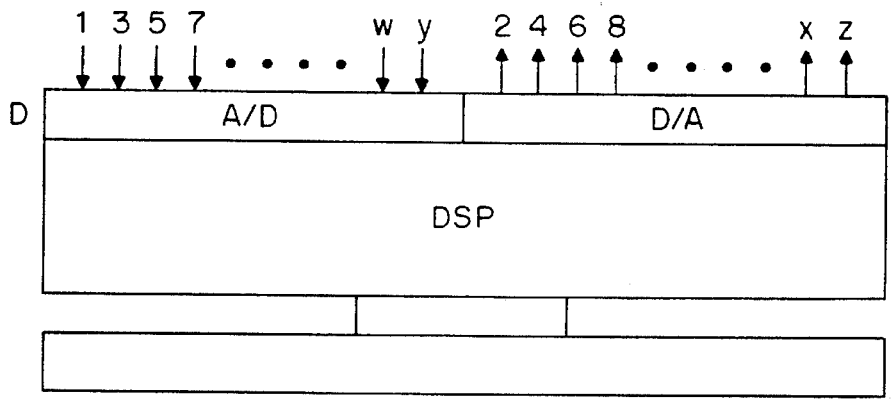
FIG. 3 shows a schematic illustration of a digital signal processor according to ther present invention.

In the embodiment shown in FIG. 1, each outlet 1, 3, 5, . . . w, y of circuits TCL1, TCR1, TCL2, . . . TCLn or TCRn is connected to inlet 2, 4, 6, 8 . . . x, z of circuits WL1, WR1, WL2 . . . WLn or WRn respectively. Instead of said direct connections said outlets 1, 3, 5, 7 . . . w and y may be connected with the inlets of a multiple channel digital signal processor DSP as shown in FIG. 3; and the outlets of said processor DSP may be connected to said inlets 2, 4, 6, 8 . . . x and z, respectively.

Inlets 1, 3, 5, 7 . . . w and y of processor DSP constitute the inlet of an analog/digital system of said processor DSP and outlets 2, 4, 6, 8 . . . x and z of processor DSP are the outlets of a digital/analog system of said processor DSP which is a 2xn-channel processor.

The programming of the DSP processor enables the generation of a quasi-quadrophonic, pseudo-spatial effect on the basis of the regulation of: delay of time; sound strength and frequency variation between the various transducers, preferably in each channel independently.

Figure 4:
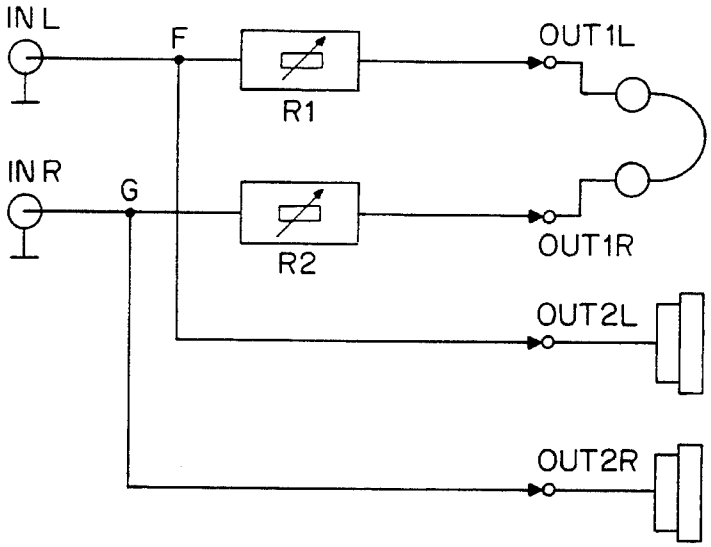
FIG. 4 shows a simplified embodiment of the device according to the present invention.

A simplified embodiment of the device according to the present invention does not comprise, for example, systems TCL1, TCL2 . . . and/or either system WL1, WR1, and/or systems WWL, WWR but only blocks R1 and R2 for the passive adjustment of the sound strength as shown in FIG. 4.

Digital signal processor DSP is provided with a keyboard and a display.

I claim:

1. An electronic device for the generation of acoustic spatial effects, characterized in that it comprises:

a) a first branch point being connected to an inlet for the signal channel of an external source;

b) a second branch point being connected to a second inlet for the right signal channel of said external source;

c) an earphone outlet for an earphone for the left ear;

d) an earphone outlet for an earphone for the right ear;

e) an outlet for a first vibrator; and f) a second outlet for a second vibrator;

between each branch point and a corresponding earphone outlet being inserted a passive circuit and each branch point being connected with the corresponding vibrator outlet via a passive circuit or via a short circuit line;

wherein the passive circuit comprises a filter system; the outlet of a first filter system is connected with a first terminal amplifier, which amplifier contains an adjustable amplifier for the control of a first earphone; the outlet of a second filter system is connected to a second terminal amplifier which contains an adjustable amplifier for the control of a second earphone; the outlet of a third filter system is connected on the one hand with the first inlet of a third terminal amplifier which contains an adjustable amplification for the control of a first vibrator transducer, and on the other hand is connected with the first inlet of a regulator system; the outlet of a fourth filter system is connected on the one hand with the first inlet of a fourth terminal amplifier, which amplifier has an adjustable amplification, for the control of a second vibrator transducer, and on the other hand is connected with a second inlet of the regulator system; a first outlet of the regulator system is connected with a second inlet of the fourth terminal amplifier and a second outlet of said regulator system is connected with the second inlet of the third amplifier.

* * * * *

UNITED STATES PATENT AND TRADEMARK OFFICE

CERTIFICATE OF CORRECTION

PATENT NO. : 5,521,982

DATED : May 28, 1996

INVENTOR(S) : Yair Schiftan

It is certified that error appears in the above-indentified patent and that said Letters Patent is hereby corrected as shown below:

On the title page item [22], "Jul. 9" should read --Jul. 6--.

Signed and Sealed this

Seventeenth Day of September, 1996

Bruce Lehman

*Attest:*

BRUCE LEHMAN

*Attesting Officer*

*Commissioner of Patents and Trademarks*